United States Patent [19]

Morimoto

[11] Patent Number: 4,724,783

[45] Date of Patent: Feb. 16, 1988

[54] A SEWING MACHINE WITH A SYNCHRONIZING FEED DEVICE

[75] Inventor: Shuzo Morimoto, Tokyo, Japan

[73] Assignee: Janome Sewing Machine Co., Ltd., Tokyo, Japan

[21] Appl. No.: 913,552

[22] Filed: Sep. 26, 1986

[30] Foreign Application Priority Data

Jun. 6, 1986 [JP] Japan ..... 61-85367[U]

[51] Int. Cl.[4] ..... D05B 27/00

[52] U.S. Cl. ..... 112/311; 112/320

[58] Field of Search ..... 112/311, 320, 313

[56] References Cited

U.S. PATENT DOCUMENTS 3,583,344 6/1971 Meier ..... 112/320

4,519,333 5/1985 Minakuchi ..... 112/311

4,611,548 9/1986 Holl ..... 112/320

*Primary Examiner*—Andrew M. Falik

*Attorney, Agent, or Firm*—Michael J. Striker

[57] ABSTRACT

A device for synchronizing feeds of a lower and upper fabric in a sewing machine, which device comprises a control cam, a presser bar, a turning plate with a movable presser thereon, a switching plate movable on the presser bar and connected to the control cam which moves the switching plate, and a control plate interconnected between the control cam and the movable presser and rotated to move the switching plate and thus the movable presser so that it may be pressed against the fabric being sewn.

7 Claims, 12 Drawing Figures

A SEWING MACHINE WITH A SYNCHRONIZING FEED DEVICE

BACKGROUND OF THE INVENTION

The present invention relates to a sewing machine in general, and more particularly to a synchronizing fabric feeding device for a sewing machine, wherein a movable fabric presser is provided in addition to the conventional fabric presser foot mounted on the lower end of a presser bar, the movable fabric presser being operated in synchronism with a feed dog to effectively and positively feed a fabric to be sewn with respect to a needle.

Generally, a sewing machine is used to sew two superposed fabrics to form up clothes or other articles. The superposed fabrics are stitched together with a machine needle while the superposed fabrics are transported with respect to the machine needle by a feed dog. As generally known, the feed dog is able to transport the fabric which is placed on the feed dog in cooperation with a fabric presser foot which is mounted on the lower end of a presser bar and presses the fabric against the feed dog with the predetermined force. In this case, it is apparent that the upper fabric lags behind the lower fabric due to the friction produced between the upper fabric and the presser foot pressed against the upper fabric. In fact, no practical problem arises when cotton or wollen fabrics and the like are stitched together which will produce little friction. However, a problem normally arises when a specific fabric such as artificial or vinyl leather and the like produces much friction in connection with the presser foot. In this case, the fabric will not be transported, or the upper fabric will lag behind the lower fabric which may be transported by the feed dog, and as a result the sewn fabrics will shrink because of puckering.

So far many devices such as an auxiliary presser foot have been provided to solve such problem, but these conventional devices are bulky and complicated in structure and also costly. Moreover, it is considerably difficult to attach or detach the auxiliary presser foot to and from the device in dependence upon the kind of fabric to be sewn. For these reasons, it has been difficult to actually reduce to practice such devices, especially for household sewing machines.

SUMMARY OF THE INVENTION

It is an object of the present invention to eliminate the defects and disadvantages of the prior art.

It is another object of the invention to provide a synchronizing fabric feeding device which is simple and compact in structure and smooth in operation.

It is yet another object of the invention to provide a feed device including an auxiliary presser foot which may be moved to an inoperative position to be maintained therein, when the device is not used.

These and other objects of the invention are attained by a synchronizing feed device which comprises a control cam, a presser bed which is vertically movable on a presser bar; a turning plate turnably supported on said presser bed; a movable presser which is supported to be turned integrally with the turning plate; a switching plate having a pin and being movable on the presser bar via said pin and operatively connected to said control cam to be moved on said presser bar, a presser spring, and a control plate having one hole connected to said movable presser bed via a link and another hole connected to the switching plate. The said control plate is operatively interconnected between said cam and said movable presser and is rotated about said one hole when the fabric is fed to thereby move upward the switching plate via said another hole so as to transmit the biasing force of the presser spring to said movable presser via the link, the movable presser bed, and the turning plate so that said movable presser may be pressed against the fabric to be sewn. The movable presser foot is turned by the movement of the feed dog together with the turning plate via the fabric under stitching between an initial position in which said feed dog starts to feed the fabric and an effected position in which said movable presser has fed the fabric in cooperation with the feed dog.

BRIEF DESCRIPTION OF THE DRAWINGS

FIGS. 7 and 8 show in views similar to those of FIGS. 1 and 2 a modification of the embodiment of FIGS. 1 to 6, wherein FIG. 7 is a vertically cross sectional view of an element part of a sewing machine seen from a face cover plate side thereof;

FIG. 8 is a vertically cross sectional view of the above part of FIG. 7 seen from an arrow B of FIG. 7;

FIGS. 9 to 12 show another embodiment of the movable presser which is applicable to the embodiment shown in FIGS. 1 to 6, and the modification thereof shown in FIGS. 7 and 8, wherein FIG. 9 is a vertically cross sectional view of a part of the sewing machine in the vicinity of the movable presser, seen from the face cover plate side thereof;

FIG. 10 is a vertically cross sectional view as seen from an arrow C of FIG. 9;

FIG. 11 is a vertical cross sectional view as seen from an arrow D of FIG. 9; and FIG. 12 is a view showing loads applied to the respective parts of the invention when the synchronizing feed is carried out.

DESCRIPTION OF PREFERRED EMBODIMENTS

A first embodiment of the invention will be explained with reference to FIGS. 1 to 3.

Figure 1:
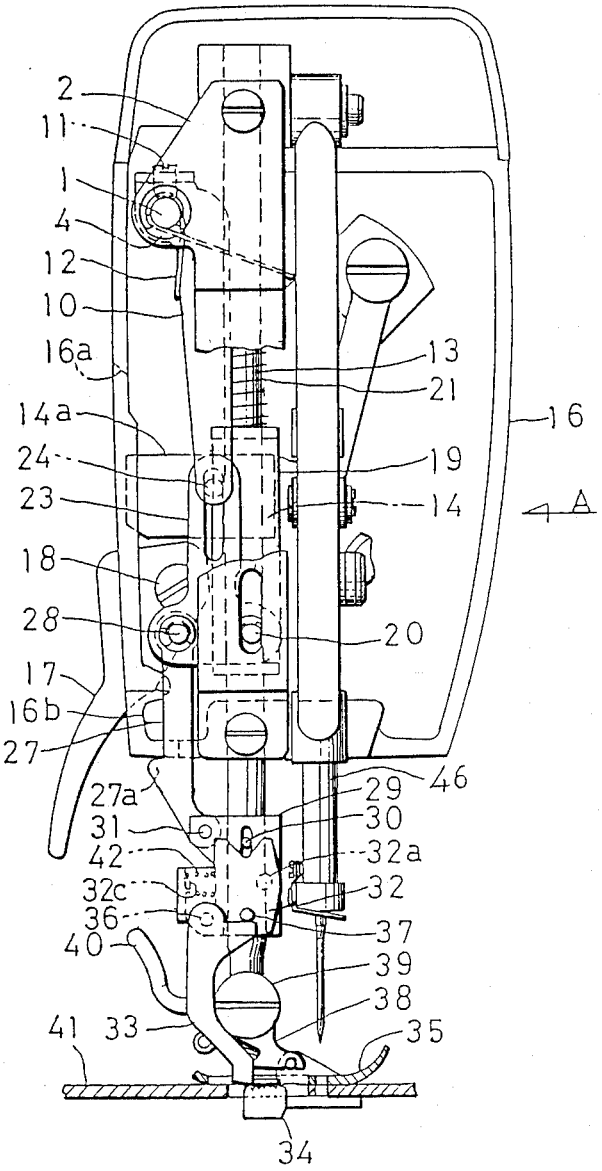
FIG. 1 is a vertical cross sectional view of a part of a sewing machine, seen from a face cover plate side thereof.
Figure 2:
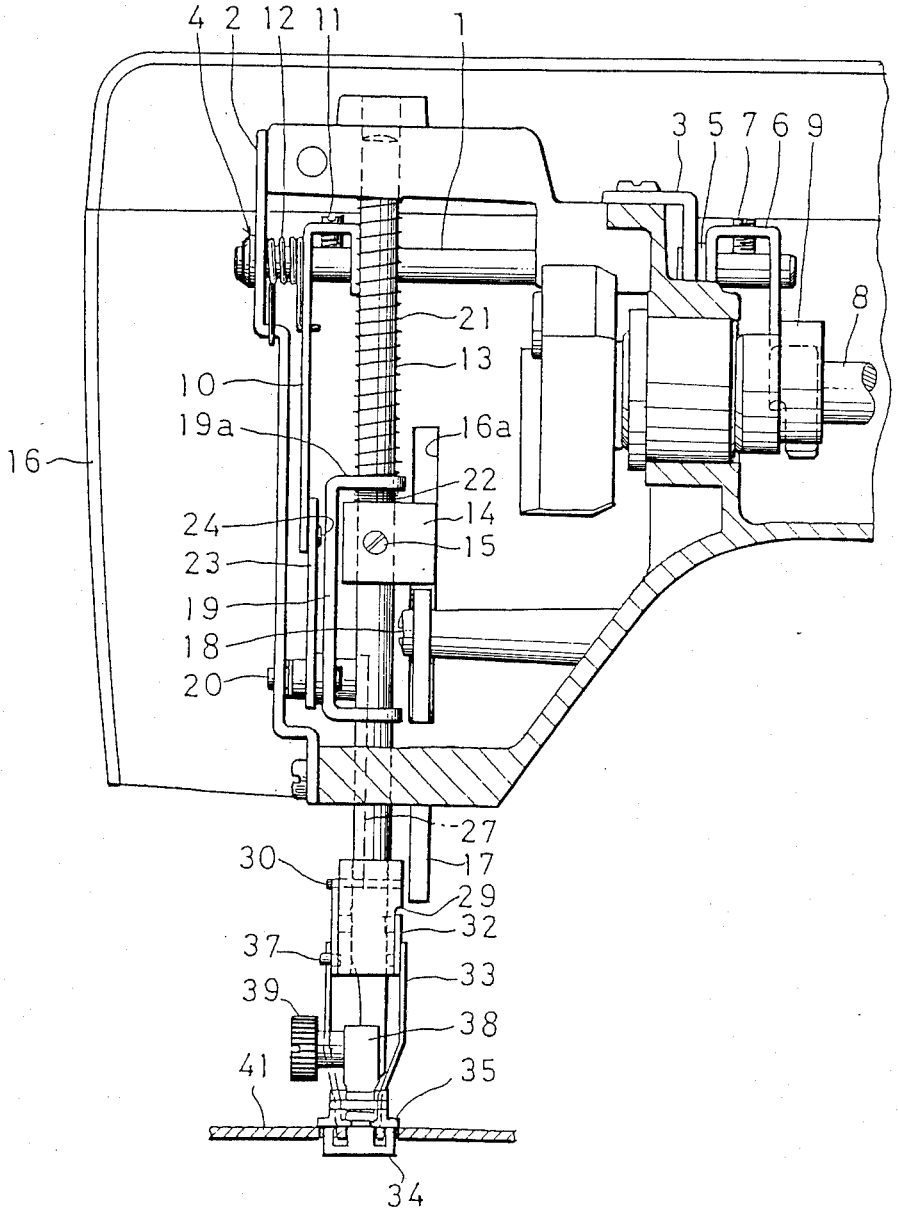
FIG. 2 is a vertical cross sectional view of the above seen from an arrow A of FIG. 1.

In FIGS. 1 and 2, a drive shaft 1 is rotatably supported on bushings 4, 5 secured on bed plates 2, 3. The drive shaft 1 is, at its one end, provided with a follower arm 6 connected thereto by a screw 7 and which follows a control cam 9 secured to an upper shaft 8, and is, at the other end, provided with a turning arm 10 connected to the drive shaft by a screw 11. A torsion coil spring 12 is mounted on the drive shaft 1 and is, at its both ends, engaged with a bed plate 2 and the turning arm 10, so that the arm 10 is biased counterclockwise around the drive shaft 1.

A presser bar 13 is secured with a presser bar holder 14 by a screw 15, and an extension 14*a* (FIG. 1) of said holder 14 is guided in a groove 16*a* formed in a machine frame 16. Below the extension 14*a*, a presser lever 17 is provided rotatably about a screw 18.

An explanation will be made with reference to FIG. 3.

A switching plate 19 is U-shaped as seen, and moved vertically on the presser bar 13 and has a pin 20 at its lower part. On the upper piece 19*a* of the switching plate 19, a presser spring 21 is disposed, and between the upper piece 19*a* and the presser bar holder 14, a further spring 22 (FIG. 2) is disposed which is weaker than the presser spring 21.

Figure 3:
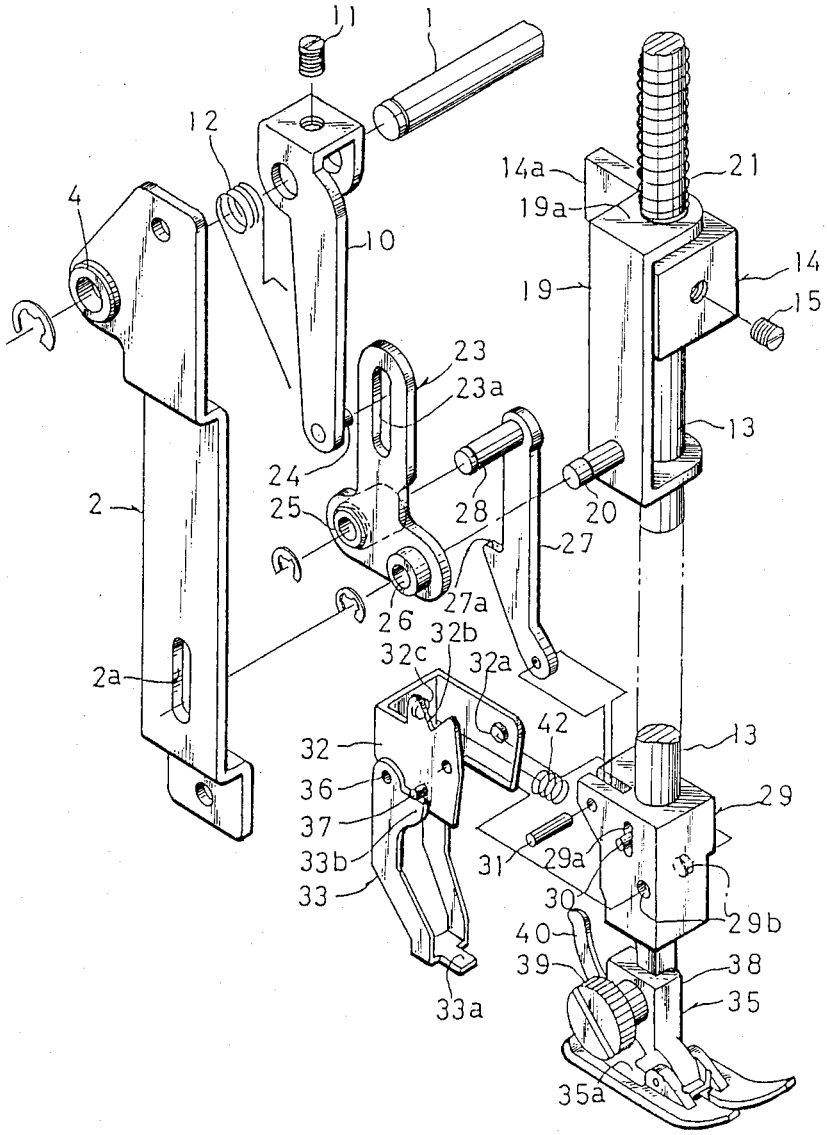
FIG. 3 is an exploded perspective view of the synchronizing feed device.

A presser control plate 23 is T shaped as seen in FIG. 3 and is formed at its extension with an oblong hole 23*a* which is engaged with a pin 24. The plate 23 is, at its bottom, formed with two holes 25 and 26. Hole 25 is inserted by a rotatable pin 28 of a downwardly extending link 27. The other hole 26 is inserted by a pin 20 of the switching plate 19. The end of the pin 20 extends beyond the hole 26. The pin 20 is guided at its end into an oblong hole 2*a* formed in the bed plate 2, so that the switching plate 19 is restrained movement with respect to the presser bar 13.

The presser bar 13 is fitted with a movable presser bed 29 at its lower part, and oblong holes 29*a* formed at both upper sides of the bed 29 are engaged with the both ends of a pin 30, so that the bed 29 is vertically movable within the range of the oblong holes 29*a* with respect to the presser bar 13.

At the upper part of the bed 29, the link 27 is rotatably supported with its lower end via a pin 31, and at the central part thereof, holes 29*b* are formed and engaged with a pair of pins 32*a* implanted on a turning plate 32 which is turnable around about said pins 32*a*.

The turning plate 32 is formed with a V-shaped groove 32*b* at its upper part, and when the movable presser bed 29 is moved upward with respect to the presser bar 13, the pin 30 contacts the bottom of the groove 32*b*, and the turning plate 32 is set at a determined angle around the pin 32*a*.

The turning plate 32 is further formed with a convex portion 32*c* at its inner part, and between the convex portion 32*c* and the movable presser bed 29 a control spring 42 is provided. Since the convex portion 32*c* is at the same level as the pins 32*a*, the turning plate 32 is normally stabilized at the plane defined by the line connecting the convex portion 32*c* with pins 32 when no external force is applied to the turning plate 32. Such a position is called hereinafter an "initial position of the turning plate 32", At the initial attitude of the turning plate 32, since the lower part of the groove 32*b* and the lower part of the oblong hole 29*a* of the movable bed 29 are at the same level with each other then when the movable bed 29 is moved upward on the presser bar 13 due to the rotation of the cam 9 on the upper shaft 8 the groove 32*b*, the turning plate 32 then turns about the pins 32*a*.

A movable presser 33 is U-shaped and formed with a pressing portion 33*a* at its lower part in opposition to the feed dog 34 to be positioned within a relief 35*a*. The movable presser 33 is connected to the turning plate 32 via a pin 36. A pair of arms 33*b* are engaged under pressure with the turning plate 32 at its lower part and contact a pin 37 for positioning, and are normally turned together with the turning plate 32 which moves about the pin 32*a*. Accordingly, the movable pressure 33 is normally positioned at a certain relation with the turning plate 32, and the pin 32*a* is positioned at an upper vertical part with respect to the pressing portion 33*a* of the movable pressure 33 at the initial attitude of the turning plate 32.

At synchronized fabric feeding, the pressure against the fabric to be sewn by the presser foot 35 is released, and the pressing portion 33*a* of the movable presser 33 is pressed against the fabric due to the action of the spring 21 to feed the fabric in association with the feed dog 34.

In order that the fabric be effectively pressed and fed it is preferable that the pressing portion 33*a* be positioned adjacent the needle dropping position at the initial position of the turning plate 32. For this purpose, the pair of pins 32*a* are offset from the axis of the presser bar 13 toward a needle bar 46 which is arranged in parallel with the presser bar 13 with a predetermined space therebetween in alignment in the fabric feeding direction as generally known. It is, however, required that the pressing portion 33*a* be so positioned as to not interfere with the needle when the fabric is fed in the bacward direction toward the machine operator.

Therefore, when the fabric is fed by the feed dog 34, the pressing portion 33*a* of the movable presser 33 is moved in the feeding direction while it presses the fabric. This movement of the portion 33*a* is effected by the turning movement of the turning plate 32 about pins 32*a* slightly downwardly. The fabric is fed by the feed dog 34 with a slight resistance from the movable presser 33. Thereby the slipping-off between the upper and lower fabrics may be prevented and the fabric with poor feeding features may be fed adequately.

Figure 6:
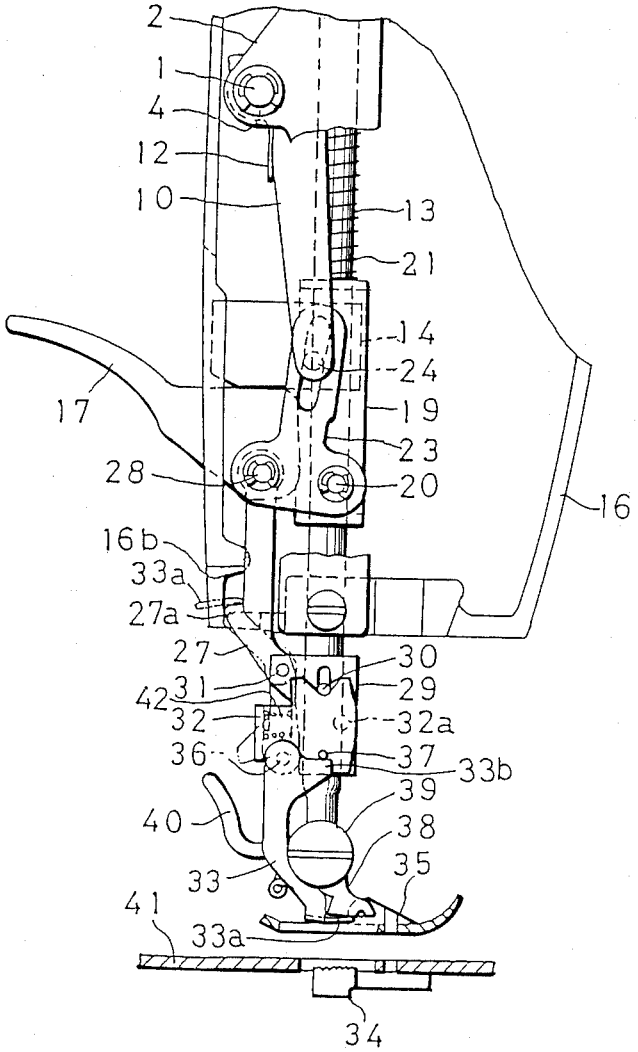
FIG. 6 shows the movable presser in a raised position where it can be rotated from an operative to a non-operative position.

The link 27 is formed with a projection 27*a*. When the synchronizing feed is not performed, the movable presser 33 is rotated clockwise about the pin 36 as shown in FIG. 6 against the pressure of the arm 33*b* with respect to the turning plate 32. When the pressing portion 33*a* is engaged with the projection 27*a* the control spring 42 is loaded and the movable presser 33 is set at the position which does not disturb other stitchings.

The machine frame 16 is formed with a cutout 16*b*, and when tthe movable presser 33 is rotated to move the pressing portion 33*a* from the lower position to the upper position as seen in FIG. 6, and when the presser bar 13 is moved upward by the lever 17, the movable presser 33 is also moved upward and the pressing portion 33*a* is held in the cutout 16*b*.

The movable presser 33 is set to the operative position for feeding the fabric in cooperation with the feed dog 34 when the movable presser 33 is turned counterclockwise in FIG. 6 until the arm 33*b* of the movable presser 33 engages the pin 37 provided at the turning plate 32.

A pressing holder 38 is connected by a stepped screw 39 to the lower part of the pressing bar 13, and is furnished with the presser foot 35 ready for exchanging by operation of a lever 40. A numeral 41 designates a needle plate.

A further explanation of the aforementioned mechanisms is given as follows. When the control cam 9 is rotated by the upper shaft 8, so that the turning arm 10 is rotated further clockwise, the control plate 23 is rotated counterclockwise about the pin 28, and the switch plate 19 is moved upward to the condition as shown in FIG. 4.

Figure 4:
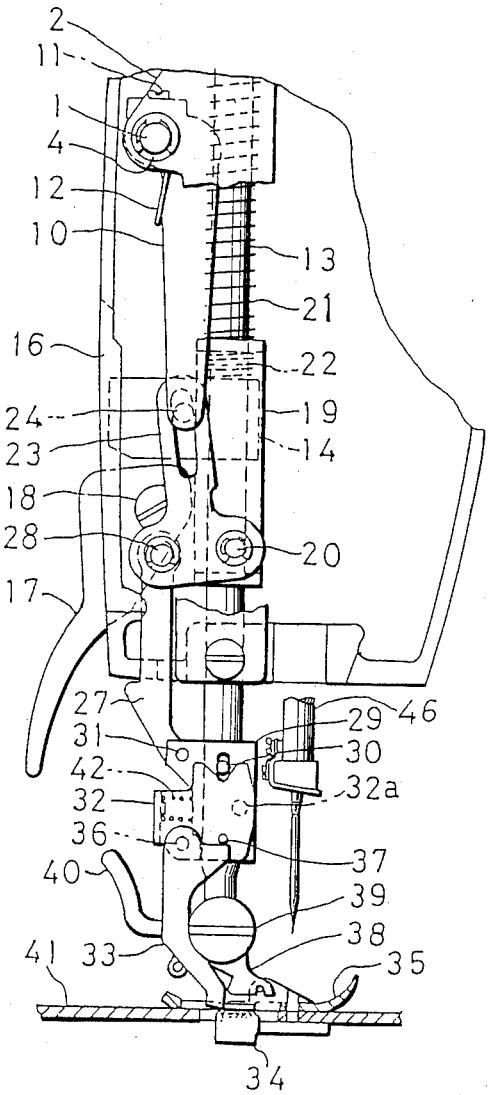
FIG. 4 is a partial view of the part of the sewing machine of FIG. 1, in a condition of starting the synchronizing feed.

In FIG. 4, since the pressing spring 21 is held by the switch plate 19, the pressing bar 13 and the presser foot 35 are effected with weak force of the spring 22. On the other hand, the movable presser 33 is actuated with the force of the pressing spring 21 via the presser control plate 23, the link 27, the movable presser bed 29 and the turning plate 32. However since the movable presser 33 is, at forward feed, rotated clockwise in FIG. 4 about the pin 32*a* in correspondence with the forward motion of the feed dog 34, and is, at backward feed, turned counterclockwise, the fabric is fed by the feed dog 34 without friction of the presser foot 35 but with small resistance of the movable presser 33. Thus, the slipping-off may be prevented, and a fabric which is difficult to be fed may smoothly advance.

When the feeding is finished, the turning arm 10 is rotated counterclockwise, whereby the presser control plate 23 is rotated about the pin 28 clockwise, and the switch plate 19 is moved down via the pin 20 whereby the presser bar is biased by the force of the spring 21 with subsequent counterclockwise rotation of the turning arm 10, the presser control plate 23 is rotated clockwise around the pin 20, and the pin 28 is moved upward. The movable preser 33 moves upward via the link 27, the movable pressing bed 29 and the turning plate 32, and separates from the fabric. Due to the action of the control spring 42, the turning plate 32 which is turned and tilted about the pin 32*a* together with the movable presser 33 turned in the fabric feeding direction, returns to the initial attitude.

The control spring 42 is set to an extent that it does not influence the fabric feed, and therefore if the fabric is caught by the movable presser 33, the turning plate 32 does not return to the initial attitude at the beginning of separating the movable presser 33 from the fabric. At the point that the movable presser 33 moves to at the highest position, the V-shaped groove 32B contacts the pin 30 so that the turning plate 32 is forcibly returned to the initial position as seen in FIG. 5.

Figure 5:
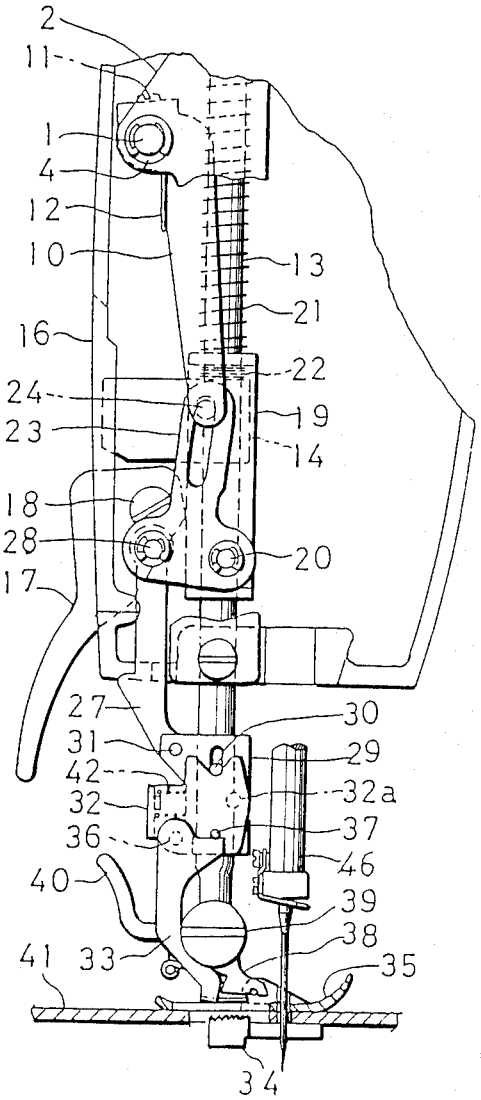
FIG. 5 is a view similar to that of FIG. 4 but in a condition of moving a upwardly movable press bed after finishing the synchronization and returning a turning plate to an initial position thereof.

The control cam 9 is further rotated by the upper shaft 8, and when the turning arm 10 begins to rotate clockwise from the position of FIG. 5, the presser control plate 23 rotates counterclockwise about the pin 20, and the pin 28 moves downward to the position of FIG. 1, and the pressing portion 33*a* of the movable presser 33 is closely adjacent to the fabric. The above mentioned actuations are repeated and the synchronizing feed is carried out A modified embodiment of that of FIGS. 1 to 6 will be explained with reference to FIGS. 7 and 8.

Figure 7:
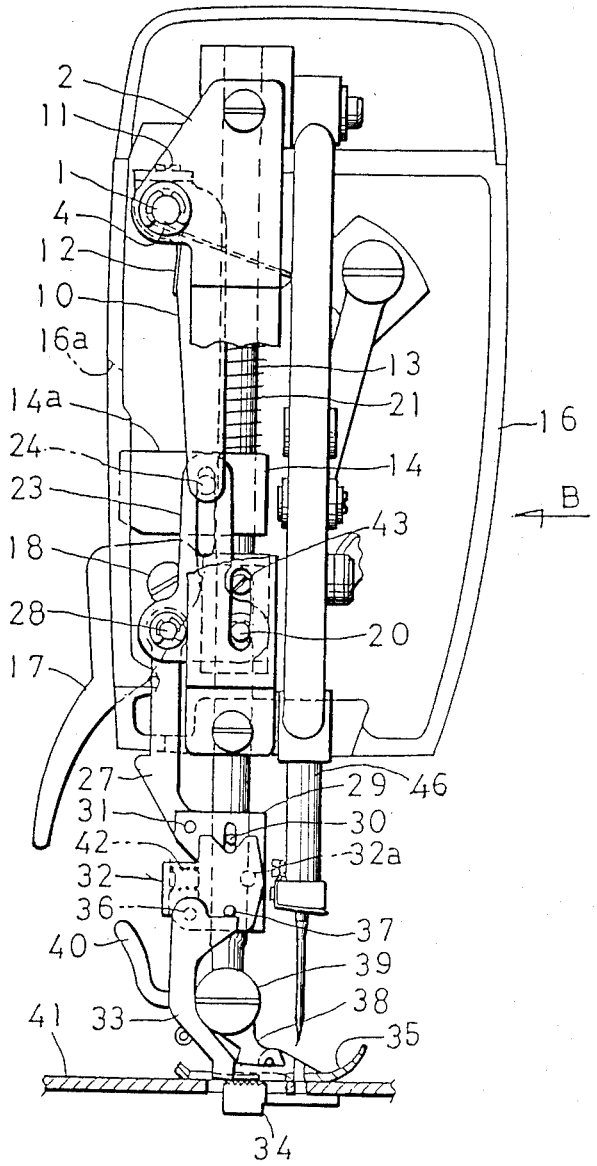
Figure 8:
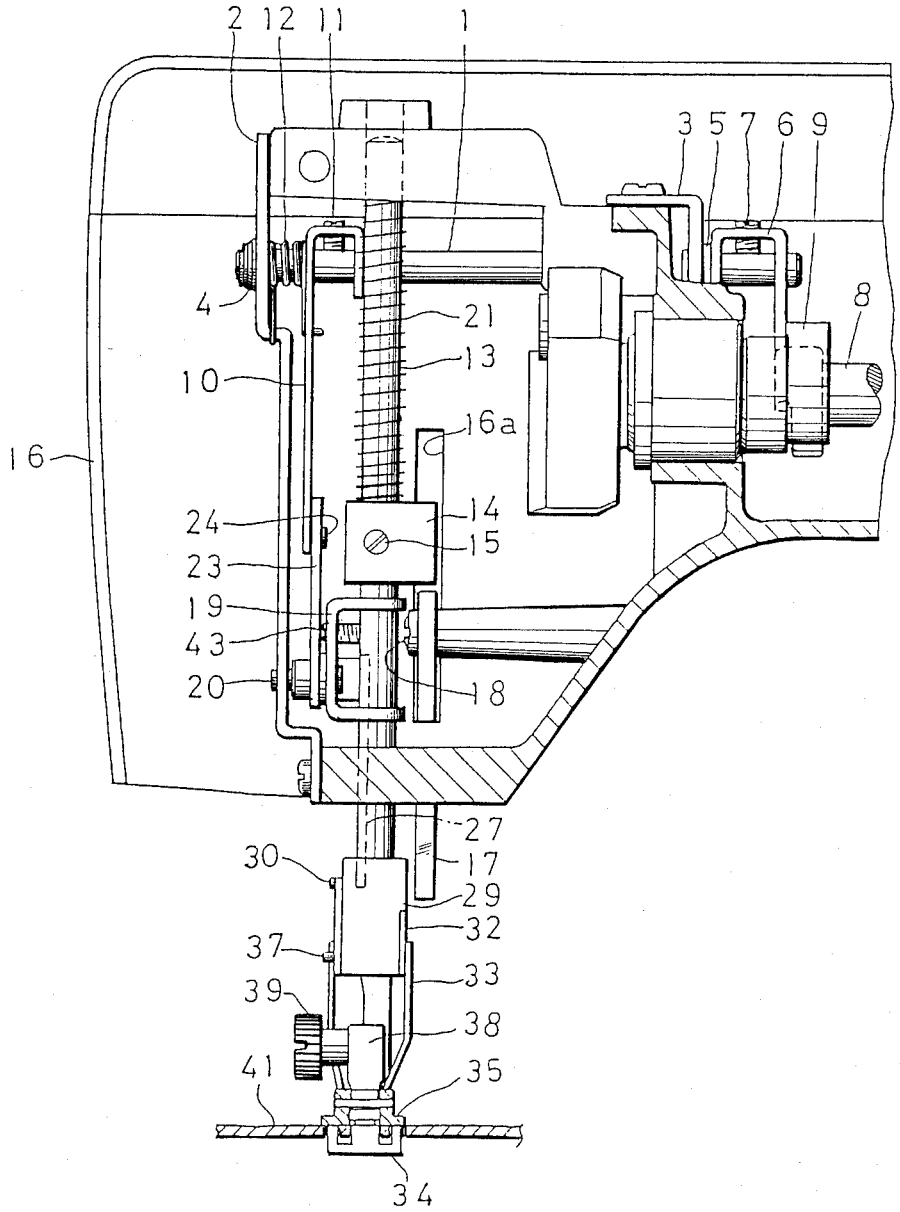
Figure 9:
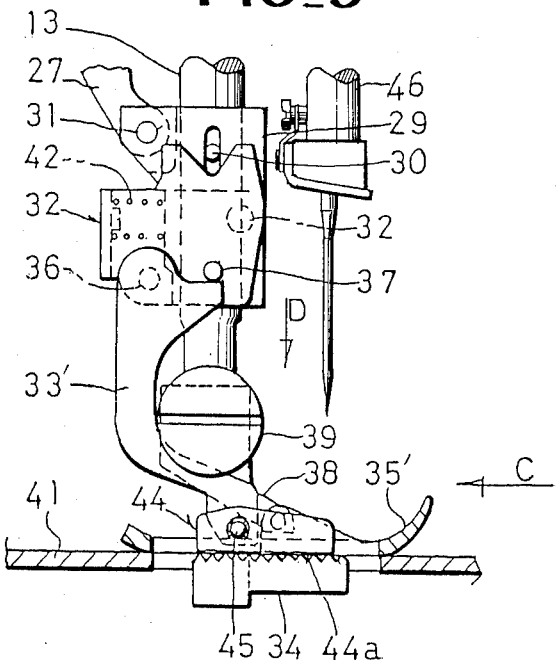
Figure 10:
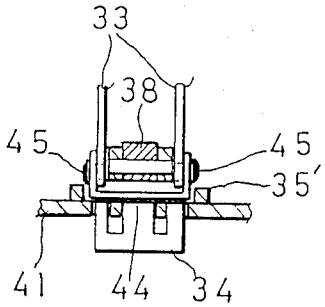
Figure 11:
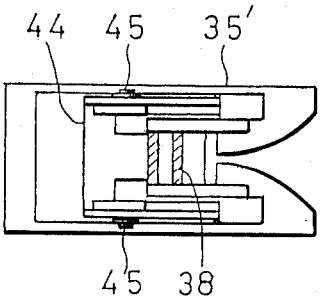

The embodiment of FIGS. 7 and 8 differs from that of FIGS. 1 to 6 in that an upper piece of the switching plate 19 is positioned under the presser bar holder 14; the switching plate 19 is secured to the presser bar 13 by a screw 43 so that said plate and bar can be moved together; a weaker spring is not provided; and the presser spring 21 directly acts on the presser bar holder 14. Other structures are the same, and the same parts and positions will be denoted with the same marks reference numerals, and the detailed explanation will be omitted.

Also in the embodiment of FIGS. 7 and 8, the synchronizing feed is performed at the same timing as in the embodiment of FIGS. 1 to 6, and at the time of the synchronizing feed, the movable presser 33 is effected with the force of the presser spring 21 via the presser control plate 23, link 27, movable pressing bed 29 and turning plate 32 in the same manner as in said embodiment. The presser bar 13 is moved upward via pin 20, the switching plate 19 and spring 42 by the presser control plate 23 which is rotated counterclockwise about the pin 28, and the presser 35 moved away from the fabric. But the feeding effect of the synchronizing feed is the same as explained above.

An explanation will be now made to a modification of the movable presser shown in FIGS. 1 to 8.

Figure 12:
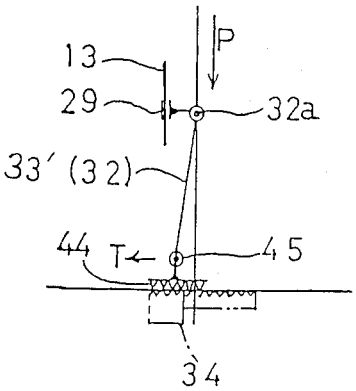

In the embodiment shown in FIGS. 9 to 12 the pressing part 44 having the feed dog 44*a* is supported by a pair of pins 45 to pivot about the lower part of the movable presser 33'. At the initial attitude of the turning plate 32, the pair of pins 45 are positioned under the pin 32*a*. The reference numeral 35' shows a presser. When the feed dog 44 is in the position as shown in FIG. 12, pins 45 are moved in the feeding direction, and due to the pressing force P, the component force T acts in the feeding direction.

The synchronizing feeding device of this invention has a movable presser foot for carrying out the fabric feeding by following movement of the feed dog via the fabric under stitching. According to the invention, the structure is very simple in comparison with sewing machines having the upper and lower feeding device, and may prevent the slipping-off during the feed of any kinds of fabrics.

When the synchronizing feed device is at rest, the movable presser foot is be rotated and may set to a position not disturbing the other stitching operations, and when the device is used, the movable presser is rotated reversely in the reverse direction and set to a synchronization feeding condition. As requested, the synchronizing feeding may be set and released.

It will be understood that each of the elements described above, or two or more together, may also find a useful application in other types of sewing machines differing from the types described above.

While the invention has been illustrated and described as embodied in a sewing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a sewing machine including a needle bar, a fabric feed device including a presser bar extended parallel to the needle bar and spaced therefrom at a predetermined space, a pressing foot mounted on a lower end of the presser bar, and a feed dog which feeds a fabric to be stitched, pressed by the pressing foot, and a synchronizing feed device comprising a control cam, a presser bed which is vertically movable on the presser bar; a turning plate turnably supported on said presser bed; a movable presser which is supported to be turned with the turning plate; a link; a switching plate having a pin and operatively connected to said control cam to be moved on said presser bar via said pin, a presser spring, and a control plate having two holes wherein one hole is connected to said movable presser bed via the said link and the other hole is connected to the said switching plate; said control plate being operatively interconnected between said cam and said movable presser to be rotated about said one hole when the fabric is fed to thereby move upward the said switching plate via said other hole so as to transmit the biasing force of the presser spring to said movable presser via the link, the movable presser bed, and the turning plate so that said movable presser may be pressed against the fabric to be sewn, the movable presser being turned by the movement of the feed dog together with the turning plate between an initial position in which said feed dog starts to feed the fabric and an effected position in which said movable presser has fed the fabric in cooperation with the feed dog.

2. A device as claimed in claim 1, wherein said turning plate is turned around a pivot which is provided on said presser bed and is offset toward said needle bar from a center axis of said presser bar on which said presser bed is mounted.

3. A device as claimed in claim 1, wherein a control spring is disposed between the turning plate and the movable presser bed so as to return the turning plate to said initial position.

4. A device as claimed in claim 1, wherein the turning plate is provided with a V-shaped groove, and a pin of the presser bar is engaged with a bottom of said groove when the movable presser bed is moved upward so as to forcibly return the turning plate to the initial position thereof.

5. A device as claimed in claim 1, wherein said movable presser has a fabric pressing portion which is engageable with a projection of said like by manual rotation of said movable presser in one direction relative to said turning plate when said movable presser is not used.

6. A device as claimed in claim 5, wherein the pressing portion is pivoted via a pair of pins at a lower part of the movable presser, and the pin at the initial position of the turning plate is positioned below a turning center of the turning plate, and when the fabric is fed a component force of the pressure of the movable presser acts in a feeding direction.

7. In a sewing machine including a needle bar, a fabric feed device including a presser bar extended parallel to the needle bar and spaced therefrom with a predetermined space, a pressing foot mounted on a lower end of the presser bar and a feed dog which feeds a fabric to be stitched, pressed by the pressing foot, and a synchronizing feed device comprising a control cam; a presser bed which is vertically movable on the presser bar; a turning plate supported on said presser bed; a movable presser which is supported to be turned with the turning plate; a link; switching plate having a pin and being secured to the presser bar and operatively connected to said cam to be moved via said pin with said presser bar; a presser spring acting on said presser bar; and a control plate having two holes with one hole connected to said movable presser bed via the link and the other hole connected to the switching plate; said control plate being operatively interconnected between said cam and said movable presser and rotated about said one hole when the fabric is fed, to thereby move upward the said switching plate with said presser bar via said other hole so as to transmit the biasing force of the presser spring to said movable presser via the said link, the movable presser bed and the turning plate, so that said movable presser may be pressed against the fabric, said movable presser being turned by the movement of the feed dog together with the turning plate between an initial position where said feed dog starts to feed the fabric and an effected position where said movable presser has fed the fabric in cooperation with said feed dog.

* * * * *